United States Patent [19]

Morrison

[11] Patent Number: 4,889,021

[45] Date of Patent: Dec. 26, 1989

[54] CLAMPING PLIER WITH LOCKING MEANS

[76] Inventor: Joseph L. Morrison, 17 Glasgow Ter., Mahwah, N.J. 07430

[21] Appl. No.: 294,361

[22] Filed: Jan. 6, 1989

[51] Int. Cl.[4] ..... B25B 7/14

[52] U.S. Cl. ..... 81/325; 81/328

[58] Field of Search ..... 81/318–325, 81/328, 369; 7/125

[56] References Cited

U.S. PATENT DOCUMENTS 1,274,427 8/1918 Landmann .
1,354,172 9/1920 Courtney .
1,377,413 5/1921 Dwelle .
1,392,194 9/1921 Mills .
1,398,122 11/1921 Bender .
2,592,807 4/1952 Jones ..... 81/369

*Primary Examiner*—D. S. Meislin
*Attorney, Agent, or Firm*—Norman B. Rainer

[57] ABSTRACT

A locking device is provided comprised of clamping pliers having a threaded adjustment screw, and an associated padlock having a long U-shaped shackle. First and second stubs associated with the padlock are adapted to enter apertures in the handles of the pliers so that the handles cannot be moved apart from their clamped or locked state. One of the stubs forces a brake member against the threaded adjustment screw.

1 Claim, 2 Drawing Sheets

CLAMPING PLIER WITH LOCKING MEANS

BACKGROUND OF THE INVENTION

This invention concerns a locking device, and more particularly relates to a clamping plier having means for preventing unauthorized release of the plier from its clamped state.

There are numerous situations where it is desired to secure structures or systems in a closed, inoperable or otherwise inaccessible condition, said secured state being easily achieved and reversed only by authorized persons. The uses of conventional key-operated and combination-operated padlocks having U-shaped shackles are manifold. However, specialized means must be present to permit interactive engagement with the lock, the most common interactive means being eyes or equivalent apertures incorporated into objects, link chains and cables capable of encircling objects, or two elements in close enough proximity to be embraced by the shackle of the padlock.

Clamping pliers as disclosed for example in U.S. Pat. No. 2,592,807, are in common usage, one popular variety being known as Vise-Grip. Such pliers are comprised of a stationary handle having a stationary jaw at one extremity and a threaded adjustment screw at the opposite extremity, and a movable handle pivotably attached to a movable jaw adapted to interact with the stationary jaw. A lever pivotably associated with the movable handle and adjustment screw causes high compressive force to be applied to objects held between the jaws when the handles are forcefully brought together. Upon closure of the handles, the jaws remain locked in position until the handles are forcefully separated. Several objects can accordingly be held together by the clamping plier in its locked state and unattended. In such state, the held objects cannot be separated, and the pliers become substantially as integral extension of said objects. Such effects could constitute locking functions if unauthorized opening of the unattended plier can be thwarted.

It is accordingly an object of the present invention to modify a clamping plier so that it can be utilized as a locking device.

It is another object of this invention to modify a clamping plier so that, in its locked state, its handles cannot be separated to the unlocked state by unauthorized persons.

It is a further object of the present invention to provide a modified clamping plier of the aforesaid nature of rugged, durable construction amendable to low cost manufacture.

These objects and other objects and advantages of the invention will be apparent from the following description.

SUMMARY OF THE INVENTION

The above and other beneficial objects and advantages are accomplished in accordance with the present invention by a locking device comprising:

(1) clamping pliers comprised of:

(a) a stationary handle having a stationary jaw at one extremity and, at the opposite extremity, a threaded adjustment screw that enters said handle and is adapted to advance toward said stationary jaw, (b) brake means disposed within said stationary handle and adapted to contact said adjustment screw, (c) a first aperture in said stationary handle adjacent said brake means, (d) a movable handle pivotably attached to a moveable jaw adapted to interact with the stationary jaw, said movable handle being adapted to move toward and away from said stationary handle, (e) a second aperture in said movable handle and positioned so as to be in substantial alignment with said first aperture when the movable handle is close to said stationary handle, and (2) a padlock comprised of:

(f) a lock case having an upper extremity, a lower extremity having key-receiving means, a key operated locking mechanism, and two parallel spaced apart channels extending between said upper and lower extremities and interactive with said locking mechanism, (g) a first stub centrally attached to said upper extremity in parallel orientation with said channels, and (h) a U-shaped shackle having two parallel arms adapted to adjustably penetrate said channels, and a second stub centered between said arms and parallel thereto and coaxially aligned with said first stub, (i) said padlock being disposed upon said clamping pliers in a manner such that said shackle arms embrace said handles, whereby , (3) when the handles are in their closest approach constituting the locked state of the pliers, the shackle may be adjustably pushed through the lock case until the stubs enter said apertures, one of said stubs further abutting against said brake means to prevent movement of said adjustment screw.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
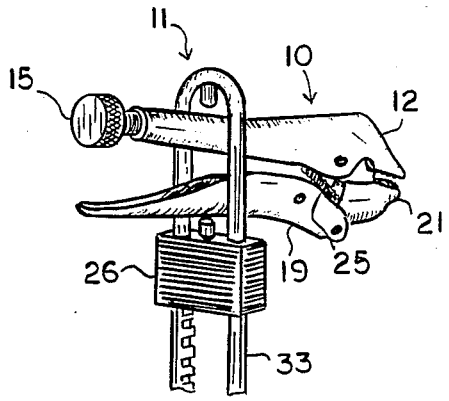
FIG. 1 is a perspective view of an embodiment of the locking device of the present invention.
Figure 2:
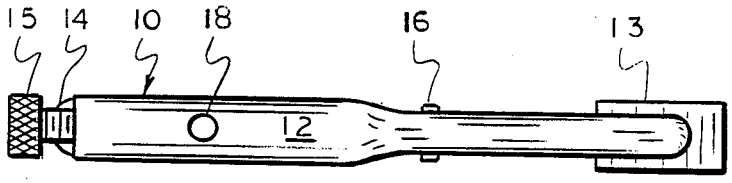
FIG. 2 is a top view of the embodiment of FIG. 1 with the padlock removed.
Figure 3:
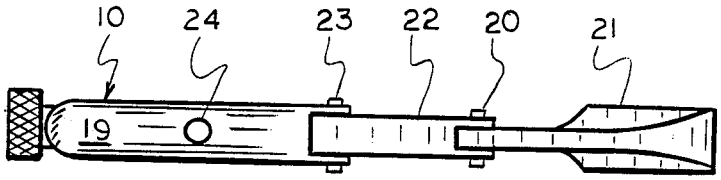
FIG. 3 is a bottom view of the embodiment of FIG. 1 with the padlock removed.
Figure 4:
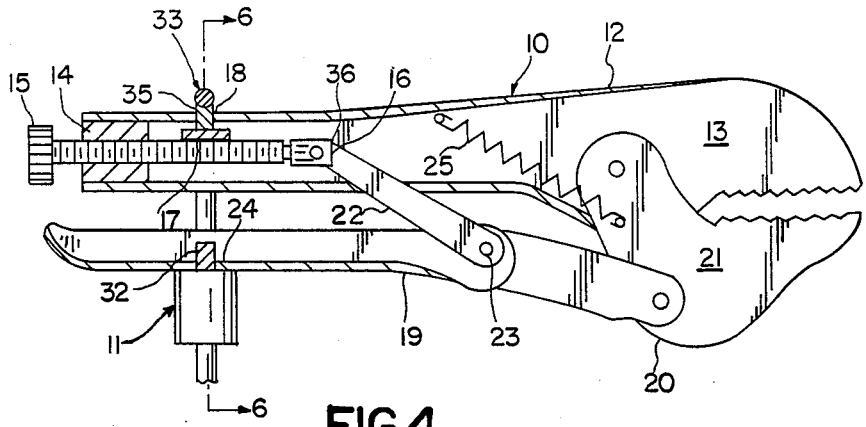
FIG. 4 is a side view, partly in section of the device of FIG. 1.

Referring to FIGS. 1–6, an embodiment of the locking device of the present invention is shown comprised of clamping pliers 10 and interactive padlock 11.

Said pliers are comprised of stationary handle 12 having stationary jaw 13 at one extremity and, at the opposite extremity, threaded adjustment screw 14 that enters said handle and is adapted to advance toward said stationary jaw. Screw 14 is provided with a knurled knob 15 at its exterior extremity. The interior extremity of screw 14 is equipped with bushing collar 36 that holds first pivot pin 16. Brake means in the form of friction pad 17 is disposed within said stationary handle in contact with screw 14 and held in place by abutment with the facing inside surfaces of said handle. A first aperture 18 is disposed in handle 12 adjacent said friction pad.

A movable handle 19 is attached by second pivot pin 20 to a movable jaw 21 adapted to interact with stationary jaw 13. Movable handle 19 is adapted to move toward and away from stationary handle 12 by virtue of connecting lever 22 which, at one extremity engages said first pivot pin 16, and at the opposite extremity attaches to handle 19 by way of third pivot pin 23. A second aperture 24 is disposed in movable handle 19 and positioned so as to be in substantial alignment with said first aperture when both handles are close together as in the locked state shown in FIG. 4. A restoring spring 25, interactive between handle 12 and movable jaw 21 serves to pull said jaw downwardly when the handles are released from their locked state.

Figure 5:
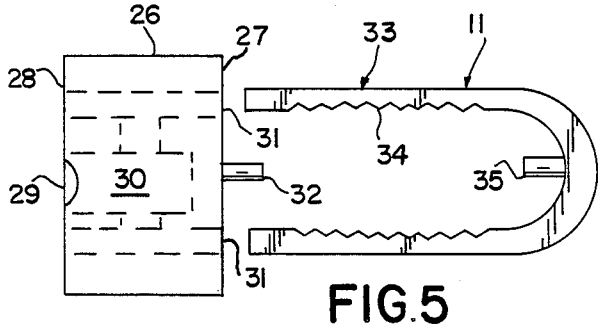
FIG. 5 is a sectional side view of an embodiment of the padlock component of the locking device of this invention.
Figure 6:
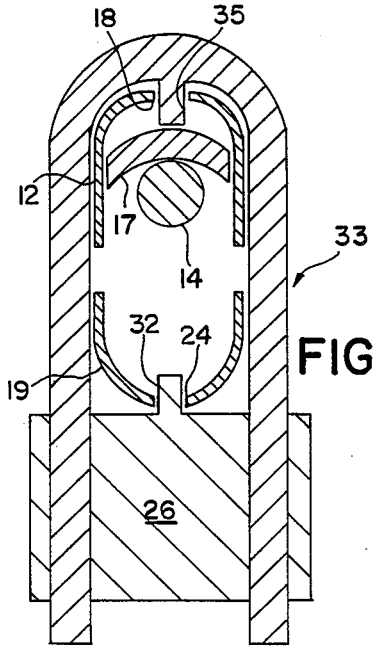
FIG. 6 is an enlarged sectional view taken upon the line 6—6 of FIG. 4.

As shown most clearly in FIG. 5, a padlock 11 is comprised of U-shaped shackle 33, and lock case 26 having upper extremity 27, lower extremity 28 having key receiving means 29, and internally disposed locking mechanism 30. Two parallel, spaced apart channels 31 extend between said upper and lower extremities in interactive relationship with said locking mechanism. A first stub 32 is centrally attached to said upper extremity in parallel orientation with said channels. Said shackle is comprised of two parallel arms 34 adapted to adjustably penetrate said channels. A second stub 35 is centered between said arms and parallel thereto and coaxially aligned with said first stub.

The padlock is disposed upon said clamping pliers in a manner such that the shackle arms embrace both handles. In operation, when screw 14 is moved to set the spacing between the jaws, and the handles are brought close together to the locked state of the pliers, the shackle is pushed through the lock case until the shackle and lock case abut against the opposed handles. In this configuration, the stubs enter said apertures, thereby thwarting removal of the padlock from the pliers. Also, one of the stubs contacts the brake means, forcing it against screw 14 to prevent turning movement thereof.

Exemplary uses of the locking device of this invention include: prevention of unauthorized opening of drawers; prevention of unauthorized use of an automobile by clamping to the shafts of the clutch pedal or brake pedal, or the accelerator rod; prevention of the opening of a door by clamping to a door hinge or protruding striker plate of a door latch mechanism; and prevention of use of an electrical appliance by clamping onto one of the prongs of a receptacle plug.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A locking device comprising:

(a) a stationary handle having a stationary jaw at one extremity and, at the opposite extremity, a threaded adjustment screw that enters said handle and is adapted to advance toward said stationary jaw, (b) brake means for preventing movement of said adjustment screw disposed within said stationary handle and adapted to contact said adjustment screw, (c) a first aperture in said stationary handle adjacent said brake means, (d) a connecting lever having first and second extremities, said first extremity pivotably associated with said adjustment screw, (e) a moveable handle pivotably joined to the second extremity of said connecting lever, and adapted to move toward and away from said stationary handle, (f) a moveable jaw pivotably associated with said moveable handle and adapted to interact with the stationary jaw when the handles are brought together in a manner whereby the spacing between the jaws is determined by said adjustment screw, (g) a second aperture in said movable handle and positioned so as to be in substantial alignment with said first aperture when the movable handle is close to said stationary handle, and (B) a padlock comprised of:

(h) a lock case having an upper extremity, a lower extremity having key-receiving means, a key operated locking means, and two parallel spaced apart channels extending between said upper and lower extremities and interactive with said locking means, (i) a first stub centrally attached to said upper extremity in parallel orientation with said channels, and (j) a U-shaped shackle having two parallel arms adapted to adjustably penetrate said channels, and a second stub emergent from said shackle and centered between said arms and parallel thereto and coaxially aligned with said first stub, (k) said padlock being disposed upon said clamping pliers in a manner such that said shackle arms embrace said handles, whereby (C) when the handles are at their closest approach, constituting the locked state of the pliers, the shackle may be adjustably pushed through the lock case until the stubs enter said apertures, said first stub further abutting against said brake means to prevent movement of said adjustment screw.

* * * * *